US007831194B2

(12) United States Patent
Lim et al.

(10) Patent No.: US 7,831,194 B2
(45) Date of Patent: Nov. 9, 2010

(54) IMAGE FORMING APPARATUS

(75) Inventors: Kwang-taek Lim, Gwangmyeong-si (KR); Won-mo Cho, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 620 days.

(21) Appl. No.: 11/236,551

(22) Filed: Sep. 28, 2005

(65) Prior Publication Data

US 2006/0072950 A1 Apr. 6, 2006

(30) Foreign Application Priority Data

Oct. 1, 2004 (KR) ..... 10-2004-0078304

(51) Int. Cl.
*G03G 15/00* (2006.01)

(52) U.S. Cl. ..... 399/400; 399/397

(58) Field of Classification Search ..... 400/388, 400/400; 399/400, 397
See application file for complete search history.

(56) References Cited

U.S. PATENT DOCUMENTS

| | | | | |
|---|---|---|---|---|
| 5,029,839 | A * | 7/1991 | Kajiwara et al. | 271/121 |
| 5,944,430 | A * | 8/1999 | Myung | 400/624 |
| 5,984,297 | A * | 11/1999 | Tanaka | 271/118 |
| 6,184,646 | B1 * | 2/2001 | Yagoshi et al. | 318/696 |
| 6,574,451 | B2 * | 6/2003 | Miyasaka et al. | 399/401 |
| 6,731,903 | B2 * | 5/2004 | Suzuki | 399/361 |
| 2002/0150413 | A1 | 10/2002 | Akita | |
| 2003/0227125 | A1 * | 12/2003 | Nakamura | 271/10.11 |
| 2004/0124577 | A1 * | 7/2004 | Lin et al. | 271/121 |

FOREIGN PATENT DOCUMENTS

| | | |
|---|---|---|
| JP | 10-010806 | 1/1998 |
| KR | 1019960039126 | 9/1996 |
| KR | 1997-10756 | 3/1997 |
| KR | 1999-17824 | 6/1999 |
| KR | 2000-19334 | 11/2000 |
| KR | 1020040055913 | 6/2004 |

* cited by examiner

*Primary Examiner*—Anthony H. Nguyen
(74) *Attorney, Agent, or Firm*—Roylance, Abrams, Berdo & Goodman, L.L.P.

(57) ABSTRACT

An image forming apparatus includes a laser scanning unit that irradiates a light. A photoconductive medium forms thereon an electrostatic latent image using the light from the laser scanning unit. A developing roller transfers a developer onto the electrostatic latent image formed on the photoconductive medium to develop the electrostatic latent image. A transferring roller forms a transfer nip in tight contact with the photoconductive medium and transfers the developer attached on the photoconductive medium onto a paper passing through the transfer nip. A paper supplying part stacks the paper thereon. A pickup roller picks up the paper stacked on the paper supplying part. A paper edge sensor senses a top edge of the paper picked up by the pickup roller. The paper picked up by the pickup roller is directly supplied toward the transfer nip. A paper moving path is reduced, thereby minimizing the whole size of the image forming apparatus. Also, the number of parts is reduced, thereby decreasing material costs.

17 Claims, 3 Drawing Sheets

IMAGE FORMING APPARATUS

CROSS-REFERENCE TO RELATED APPLICATIONS

This application claims the benefit under 35 U.S.C. §119 (a) of Korean Patent Application No. 2004-78304, filed Oct. 1, 2004, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus enabling a printing paper picked up by a pickup roller to be directly transferred from a paper supplying part to a photoconductive medium.

2. Description of the Related Art

Generally, an electrophotographic image forming apparatus, such as laser beam printer, produces an electrostatic latent image on a photoconductive medium, for example, a photoconductive belt. The electrostatic latent image is developed by developers of certain colors and the developed image is transferred onto a paper, thereby obtaining a desired image.

FIG. 1 schematically shows printing processes of a conventional electrophotographic image forming apparatus 1.

Referring to FIG. 1, a surface of a photoconductive medium 3 is evenly charged by electric discharge of an electrifying roller 2. The photoconductive medium 3 is exposed to a laser beam irradiated from a laser scanning unit 5 by a predetermined pattern, and therefore, a desired electrostatic latent image is formed on the surface of the photoconductive medium 3. Rotating the photoconductive medium 3 in contact with a developing roller 7 develops the electrostatic latent image formed on the photoconductive medium 3 into a visible image with a toner.

The paper stacked on a paper supplying part 9 is transferred toward a feeding roller 13 by a pickup roller 11 and then toward a transferring roller 15 by the feeding roller 13. The toner image formed on the photoconductive medium 3 is transferred by pressure of the transferring roller 15. The toner image transferred onto the paper is fixed by heat and pressure of a fusing roller 17 and transferred toward a paper discharging tray 21 by a discharging roller 18, thereby fulfilling a printing job as desired by a user.

The image forming apparatus 1 operating as described above may be further equipped with a paper supplying cassette for increasing supply of the paper. An example of this is disclosed in Korean Patent Publication No. 1998-020607, which was laid open on Jun. 25, 1998, and entitled "Feeding device of electrophotographic processor".

Recently, as various functions are added to a fundamental image forming apparatus, as shown in the above Korean patent publication, downsizing of the apparatus has been in demand.

However, since the conventional image forming apparatus has to include a dedicated feeding roller 13 for moving the paper picked up by the pickup roller 11 to the photoconductive medium 3, a paper path 23 is generally long, and accordingly, the whole apparatus becomes bulky.

Also, providing the dedicated feeding roller 13, the number of parts increases, thereby increasing material costs.

Accordingly, a need exists for an improved image forming apparatus that directly transfers paper picked up by a pickup roller to a photoconductive medium of a developing unit to shorten a paper path through the image forming apparatus.

SUMMARY OF THE INVENTION

Accordingly, an aspect of the present invention is to provide an image forming apparatus enabling a paper picked up by a pickup roller to be directly transferred toward a photoconductive medium of a developing unit to shorten a paper moving path, thereby reducing the whole size of the apparatus.

Another aspect of the present invention is to provide an image forming apparatus capable of saving material costs by omitting a feeding roller.

An image forming apparatus includes a laser scanning unit for irradiating a light. A photoconductive medium forms thereon an electrostatic latent image using the light from the laser scanning unit. A developing roller transfers a developer onto the electrostatic latent image formed on the photoconductive medium to develop the electrostatic latent image. A transferring roller forms a transfer nip in tight contact with the photoconductive medium and transfers the developer attached on the photoconductive medium onto a paper passing through the transfer nip. A paper supplying part stacks thereon the paper. A pickup roller picks up the paper stacked on the paper supplying part. A paper edge sensor senses a top end of the paper picked up by the pickup roller, wherein the paper picked up by the pickup roller is directly supplied toward the transfer nip.

A rotational speed of the pickup roller is equal to or greater than that of the photoconductive medium. The rotational speed of the pickup roller is faster than the photoconductive medium by 0~5%. More preferably, the rotational speed of pickup roller faster than the photoconductive medium by 1~2%.

A distance $D_1$ is equal to or greater than a distance $D_2$ when the distance $D_1$ refers to a vertical distance from a sensing point $C_1$ of the paper edge sensor to an image-forming point $C_2$ of the photoconductive medium and the distance $D_2$ refers to a circumference of the photoconductive medium from the image-forming point $C_2$ to a transfer nip $C_3$ between the transferring roller and the photoconductive medium. A pickup point $C_4$ of the pickup roller is equal to or lower than the sensing point $C_1$ of the paper edge sensor.

The photoconductive medium and the transferring roller are disposed at an upper portion of the pickup roller, such that the paper picked up by the pickup roller is vertically transferred.

Another aspect of the present invention is to provide an image forming apparatus including a paper supply part for stacking thereon paper. A pickup roller picks up the paper stacked on the paper supplying part. A developing unit is disposed at a lower stream of transfer of the paper picked up by the pickup roller and includes a photoconductive medium on which a developer is attached. A transferring roller forms a transfer nip in tight contact with the photoconductive medium and transfers the developer attached on the photoconductive medium onto a paper passing through the transfer nip. The paper picked up by the pickup roller is directly supplied toward the transfer nip.

A rotational speed of the pickup roller is equal to or greater than that of the photoconductive medium. The rotational speed of the pickup roller is faster than the photoconductive medium by 0~5%. More preferably, the rotational speed of the pickup roller is faster than the photoconductive medium by 1~2%.

The image forming apparatus may further include a paper edge sensor for sensing a top end of the paper between the pickup roller and the transfer nip. A distance $D_1$ is equal to or greater than a distance $D_2$ when the distance $D_1$ refers to a vertical distance from a sensing point $C_1$ of the paper edge sensor to an image-forming point $C_2$ of the photoconductive medium and the distance $D_2$ refers to a circumference of the photoconductive medium from the image-forming point $C_2$ to a transfer nip $C_3$ between the transferring roller and the photoconductive medium. A pickup point $C_4$ of the pickup roller is equal to or lower than the sensing point $C_1$ of the paper edge sensor.

Other objects, advantages and salient features of the invention will become apparent from the following detailed description, which, taken in conjunction with the annexed drawings, discloses preferred embodiments of the invention.

BRIEF DESCRIPTION OF THE DRAWING FIGURES

The above aspect and other features of the present invention will become more apparent by describing in detail exemplary embodiments thereof with reference to the attached drawing figures, wherein.

Throughout the drawings, like reference numerals will be understood to refer to like parts, components and structures.

DETAILED DESCRIPTION OF EXEMPLARY EMBODIMENTS

Hereinafter, exemplary embodiments of the present invention are described in detail with reference to the accompanying drawing figures.

The matters defined in the description, such as a detailed construction and elements thereof, are provided to assist in a comprehensive understanding of the invention. Thus, it is apparent that various changes and modifications to the examples described herein may be made without departing from the scope of the present invention. Also, well-known functions or constructions are omitted to provide a clear and concise description.

Figure 1:
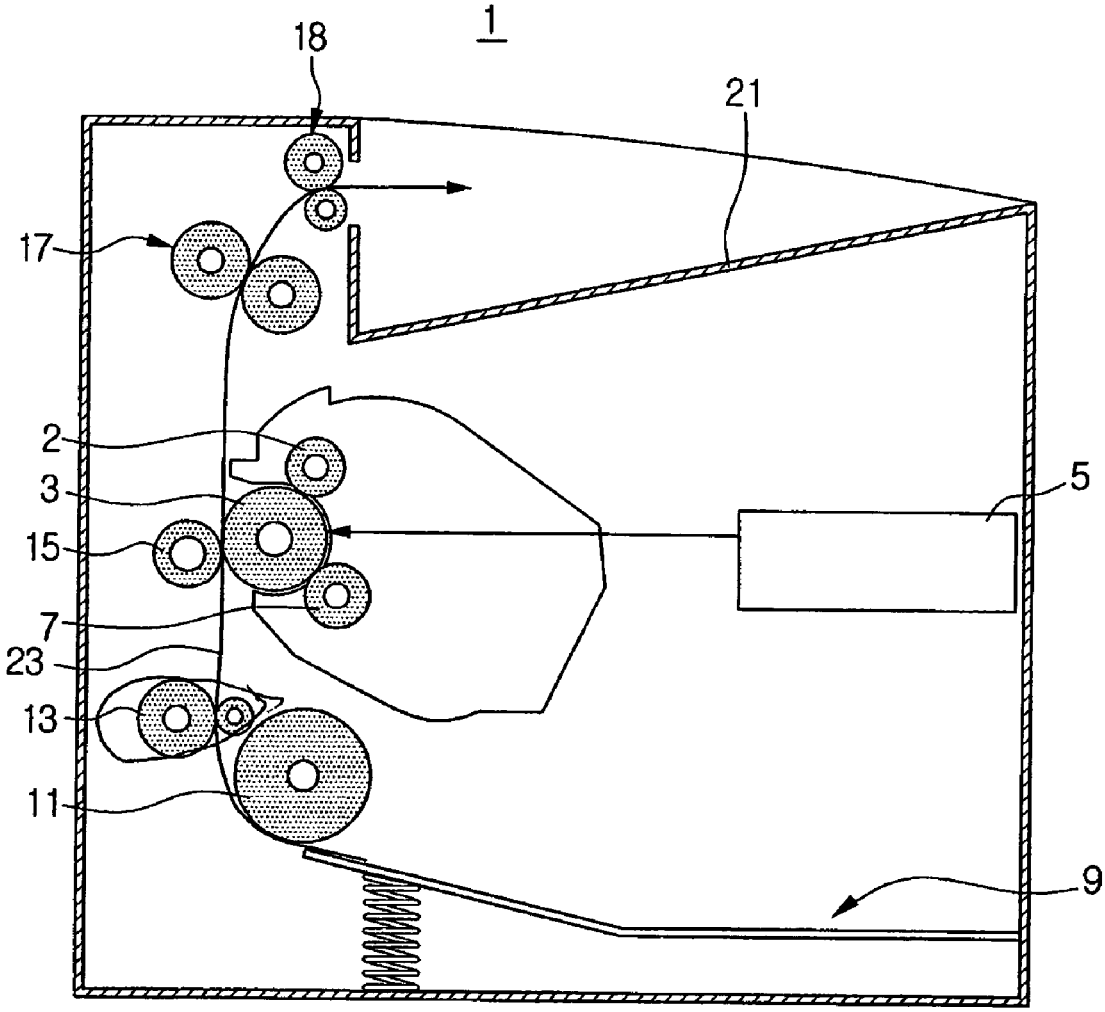
FIG. 1 (PRIOR ART)
FIG. 1 is a schematic view of the printing processes of a conventional electrophographic image forming apparatus.
Figure 2:
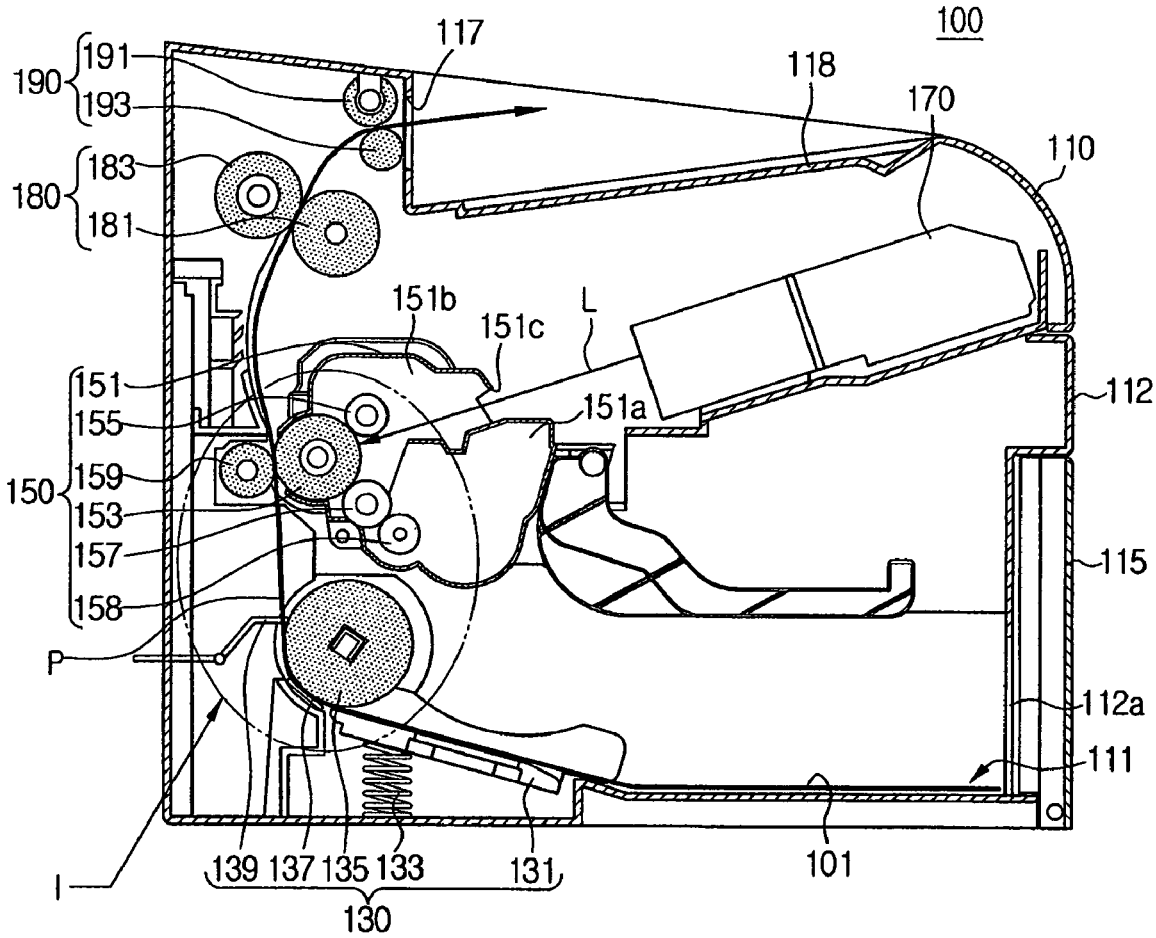
FIG. 2 is a schematic sectional view of an image forming apparatus according to an embodiment of the present invention.

FIG. 2 is a sectional view schematically showing the whole structure of an image forming apparatus according to an embodiment of the present invention.

Referring to FIG. 2, an image forming apparatus 100 includes a main body 110, a paper supplying unit 130, a developing unit 150, a laser scanning unit 170, a fusing unit 180 and a paper discharging unit 190.

The main body 110 has a cover 112 constituting a paper supplying part 111 of which an inner bottom is stacked with paper 101, and that opens and closes one side of the main body 110. When the cover 112 is opened, a user may easily mount and dismount the developing unit 150 with respect to the main body 110. The cover 112 includes a paper supplying opening 112*a* for supplying paper 101 therethrough from outside of the main body 110 into the paper supplying part 111. An opening cover 115 opens and closes the paper supplying opening 112*a*. The opening cover 115 is kept opened during the image forming process, so that the paper 101 is stacked on the opening cover 115, and is partly protruded out of the main body 110. The main body 110 has a paper discharging opening 117 at an upper part thereof to discharge the paper 101 having thereon an image fixed by the fusing unit 180. Additionally, a discharging tray 118 stacks thereon the paper 101 discharged through the paper discharging opening 117. Although the present embodiment has the paper supplying part 111 integrally formed on the inner bottom of the main body 110, alternatively a removable paper supplying cassette may be provided.

The paper supplying unit 130 supplies a plurality of papers 101 stacked on the paper supplying part 111 to the developing unit 150.

The paper supplying unit 130 includes a knock-up plate 131 mounted in the paper supplying part 111 to support thereon a plurality of paper sheets. A compressing spring 133 is mounted under the knock-up plate 131 to elastically bias the knock-up plate 131 upwardly. A pickup roller 135 picks up the paper 101 stacked on the knock-up plate 131 and a friction pad 137 generates friction in contact with the pickup roller 135 to separate a sheet of the paper 101.

The paper supplying unit 130 further includes a paper edge sensor 139 that senses a top edge of the paper 101 that is picked up by the pickup roller 135 and supplied toward the developing unit 150. The paper edge sensor 139 measures a print margin of the paper 101. The paper edge sensor 139 senses the top edge of the paper 101 and sends a signal to a control part. The control part performs counting from a time point of sensing the top edge of the paper 101 and commands to output a predetermined light through the laser scanning unit 170 after a predetermined time. Therefore, the image formed on the paper by the developing unit 150 is processed with a certain margin from a top edge of the paper 101.

The developing unit 150 forms the image on the paper 101 supplied by the pickup roller 135. The developing unit 150 has a cartridge 151 having a toner chamber 151*a* that stores toner and a developing chamber 151*b* that forms an image on the paper with the toner transferred from the toner chamber 151*a*. The developing chamber 151*b* has therein a photoconductive medium 153 rotated at a certain speed and that partly protrudes out of the cartridge 151. An electrifying roller 155 electrifies a surface of the photoconductive medium 153 by a certain voltage and is mounted at one side of the photoconductive medium 153. At another side of the photoconductive medium 153, a supplying roller 158 is mounted to supply the toner to the developing roller 157. Additionally, a transferring roller 159, which is biased by a certain pressure, is mounted to the photoconductive medium 153 to transfer the image formed on the photoconductive medium 153 to the paper supplied by the pickup roller 135. The photoconductive medium 153 is preferably integrally formed with the cartridge 151 in one exemplary embodiment. Alternatively, the photoconductive medium 153 may be separately provided on the outside of the cartridge 151.

The laser scanning unit 170 is mounted at one side of the cartridge 151 to form the electrostatic latent image on the surface of the photoconductive medium 153 by scanning the predetermined light, such as a laser beam L, required for image formation. The cartridge 151 has a light inlet 151*c* through which the light scanned by the laser scanning unit 170 passes.

The fusing unit 180 fixes a toner image of the powder form transferred onto the paper by the transferring roller 159 by heating the paper. The fusing unit 180 includes a heating roller 181 having therein a heat generator, such as halogen lamp, and a pressing roller 183 contacting the heating roller 181 with a certain pressure.

The paper discharging unit 190 discharges through the paper discharging opening 117 of the main body 110 the paper having thereon the image fixed by the fusing unit 180. The paper discharging unit 190 includes a paper discharging roller 191 and a paper-discharging idle roller 193 rotating in contact with the paper discharging roller 191.

Hereinbelow, printing processes of the above-structured image forming apparatus 100 are described.

First, the pickup roller 135 is rotated upon a print command. The paper 101 stacked on the knock-up plate 131 is separated by friction of the pickup roller 135 with the friction pad 137 and supplied between the photoconductive medium 153 and the transferring roller 159.

Simultaneously, the surface of the photoconductive medium 153 is evenly charged by the electrifying roller 155. The charged surface of the photoconductive medium 153 is exposed to the laser beam L irradiated from the laser scanning unit 170, thereby forming the desired electrostatic latent image. The developing roller 157 adjacent to the surface of the photoconductive medium 153 is rotated to thereby form the toner image from the electrostatic latent image. The transferring roller 159 rotates, pressing the photoconductive medium 153, and transfers the toner image formed on the photoconductive medium 153 onto the paper 101 supplied by the paper supplying unit 130.

While being transferred and passed through between the heating roller 181 and the pressing roller 183, the paper 101 is heated by a predetermined temperature and pressed. Accordingly, the toner image in the form of powder is fixed on the paper 101.

The paper 101 on which the toner image is fixed is transferred by rotational power of the paper discharging roller 191 and the paper-discharging idle roller 193, discharged through the paper discharging opening 117, and then stacked on the paper discharging tray 118, thereby completing the printing work.

According to the above-structured image forming apparatus 100, the paper 101 picked up by the pickup roller 135 is directly transferred toward the photoconductive medium 153. Therefore, the paper moving path between the pickup roller 135 and the developing unit 150 is shortened. Accordingly, the size of the whole apparatus is minimized and the material costs reduced.

Although FIG. 2 illustrates the structure in which the developing unit 150, the fusing unit 180 and the paper discharging unit 190 are vertically arranged in order at an upper portion of the pickup roller 135, the present invention is not limited to this structure. The arrangement of the pickup roller 135, the developing unit 150, the fusing unit 180 and the paper discharging unit 190 may be varied for application to other image forming apparatuses having different paper moving paths.

To directly supply the picked-up paper 101 to the developing unit 150, the transferring speed of the paper 101 needs to be substantially constant. Therefore, relationships in speed and distance between the pickup roller 135 and the photoconductive medium 153 are an important matter.

For example, if the pickup roller 135 rotates slower than the photoconductive medium 153, the paper 101 may not be transferred between the photoconductive medium 153 and the transferring roller 159, resulting in paper slippage. To prevent this, relationships in speed and a distance condition between the photoconductive medium 153 and the pickup roller 135 are suggested as follows.

Figure 3:
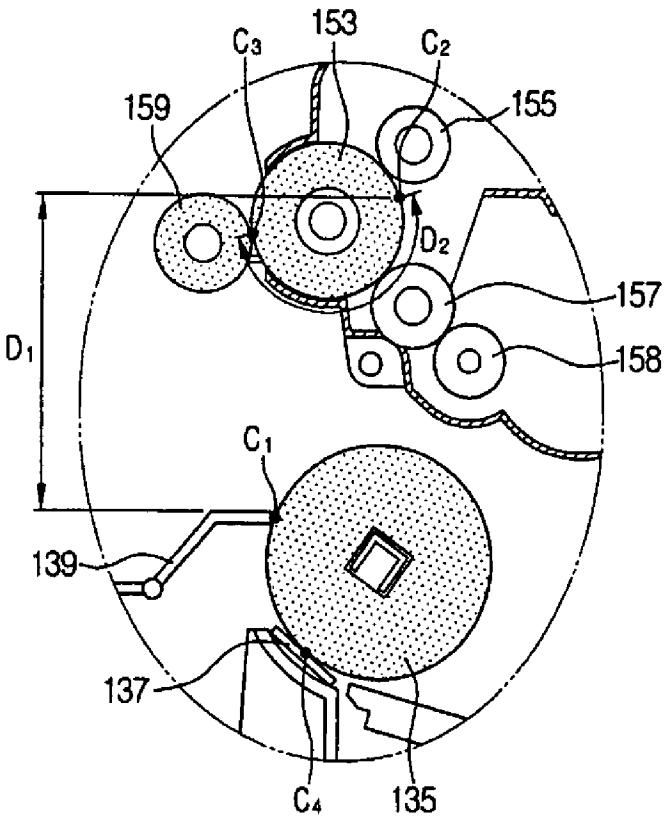
FIG. 3 is an enlarged view of a pickup roller and a photoconductive medium of FIG. 2.

FIG. 3 is a view showing the speed relationship between the pickup roller 135 and the photoconductive medium 153.

Referring to FIG. 3, a distance $D_1$ refers to a vertical distance from a sensing point $C_1$ of the paper edge sensor 139 to an image-forming point $C_2$ of the photoconductive medium 153 and a distance $D_2$ refers to a circumferential distance of the photoconductive medium 153 from the image-forming point $C_2$ to a transfer nip $C_3$ between the transferring roller 159 and the photoconductive medium 153. The distance $D_1$ is substantially equal to or greater than the distance $D_2$. Additionally, a pickup point $C_4$ of the pickup roller 135 is preferably equal to or lower than the sensing point $C_1$ of the paper edge sensor 139.

The pickup roller 135 preferably rotates faster than the photoconductive medium 153 preferably by approximately 0~5%.

When the pickup roller 135 and the photoconductive medium 153 rotate at substantially the same speed, transfer of the paper may be slowed because of the friction between the pickup roller 135 and the friction pad 137. Therefore, most preferably, the pickup roller 135 rotates faster than the photoconductive medium 153 by 1~2%.

By the above structure, the rotational speed of the pickup roller 135 becomes faster than that of the photoconductive medium 153. Accordingly, the paper 101 is transferred between the photoconductive medium 153 and the transferring roller 159 without generating the paper slip.

As is appreciated from the above description, the image forming apparatus according to an exemplary embodiment of the present invention is structured in a manner that the paper 101 picked up by the pickup roller 135 is directly transferred toward the photoconductive medium 153 of the developing unit 150, thereby shortening a transfer path of the paper 101 from the pickup roller 135 to the developing unit 150. Consequently, the size of the whole image forming apparatus is also reduced.

Furthermore, the number of parts is reduced, thereby reducing material costs.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus, comprising:

a laser scanning unit to irradiate a light;

a photoconductive medium to form thereon an electrostatic latent image using the light from the laser scanning unit;

a developing roller to transfer a developer onto the electrostatic latent image formed on the photoconductive medium to develop the electrostatic latent image;

a transferring roller to form a transfer nip in tight contact with the photoconductive medium and to transfer the developer attached on the photoconductive medium onto a paper passing through the transfer nip;

a paper supplying part upon which the paper is stacked;

a pickup roller to pick up the paper stacked on the paper supplying part at a pickup point $C_4$;

a paper edge sensor to sense a top edge of the paper picked up by the pickup roller at a sensing point $C_1$, the paper picked up by the pickup roller being directly supplied toward the transfer nip; and a friction pad disposed downstream of the paper supplying part and always applying pressure on the pickup roller, wherein a first height of the pickup point $C_4$ of the pickup roller is substantially equal to or lower than a second height of the sensing point $C_1$ of the paper edge sensor.

2. The image forming apparatus of claim 1, wherein a rotational speed of the pickup roller is equal to or greater than that of the photoconductive medium.

3. The image forming apparatus of claim 2, wherein the rotational speed of the pickup roller is faster than the photoconductive medium by approximately 0 to 5%.

4. The image forming apparatus of claim 3, wherein the rotational speed of the pickup roller is faster than the photoconductive medium by approximately 1 to 2%.

5. The image forming apparatus of claim 1, wherein a distance $D_1$ is substantially equal to or greater than a distance $D_2$, the distance $D_1$ being a vertical distance from the sensing point $C_1$ of the paper edge sensor to an image-forming point $C_2$ of the photoconductive medium and the distance $D_2$ being a circumferential distance of the photoconductive medium from the image-forming point $C_2$ to a transfer nip $C_3$ between the transferring roller and the photoconductive medium.

6. The image forming apparatus of claim 1, wherein the photoconductive medium and the transferring roller are disposed downstream of the pickup roller with respect to a paper conveying path.

7. The image forming apparatus of claim 6, wherein the paper picked up by the pickup roller is vertically transferred.

8. An image forming apparatus, comprising:

a paper supply part upon which paper is stacked;

a pickup roller to pick up the paper stacked on the paper supplying part at a pickup point $C_4$;

a developing unit disposed downstream of the pickup roller with respect to a paper conveying path and includes a photoconductive medium on which a developer is attached;

a transferring roller forms a transfer nip in tight contact with the photoconductive medium and transfers the developer attached on the photoconductive medium onto a paper passing through the transfer nip, the paper picked up by the pickup roller being directly supplied toward the transfer nip;

a paper edge sensor to sense a top edge of the paper between the pickup roller and the transfer nip at a sensing point $C_1$; and a friction pad disposed downstream of the paper supply part and always applying pressure on the pickup roller, wherein a first height of the pickup point $C_4$ of the pickup roller is substantially equal to or lower than a second height of the sensing point $C_1$ of the paper edge sensor.

9. The image forming apparatus of claim 8, wherein a rotational speed of the pickup roller is substantially equal to or greater than that of the photoconductive medium.

10. The image forming apparatus of claim 9, wherein the rotational speed of the pickup roller is faster than the photoconductive medium by approximately 0 to 5%.

11. The image forming apparatus of claim 8, wherein the rotational speed of the pickup roller is faster than the photoconductive medium by approximately 1~2%.

12. The image forming apparatus of claim 8, wherein a distance $D_1$ is substantially equal to or greater than a distance $D_2$, the distance $D_1$ being a vertical distance from the sensing point $C_1$ of the paper edge sensor to an image-forming point $C_2$ of the photoconductive medium and the distance $D_2$ being a circumferential distance of the photoconductive medium from the image-forming point $C_2$ to a transfer nip $C_3$ between the transferring roller and the photoconductive medium.

13. The image forming apparatus of claim 8, wherein the photoconductive medium and the transferring roller are disposed downstream of the pickup roller with respect to the paper conveying path.

14. The image forming apparatus of claim 13, wherein the paper picked up by the pickup roller is vertically transferred.

15. An image forming apparatus, comprising:

a paper supply part upon which paper is stacked;

a pickup roller to pick up the paper stacked on the paper supplying part;

a developing unit disposed downstream of the pickup roller with respect to a paper conveying path and including a photoconductive medium on which a developer is attached;

a transferring roller to form a transfer nip in tight contact with the photoconductive medium and to transfer the developer attached on the photoconductive medium onto a paper passing through the transfer nip, the paper picked up by the pickup roller being directly supplied toward the transfer nip;

a friction pad disposed downstream of the paper supply part and always applying pressure on the pickup roller; and a paper edge sensor disposed downstream of the friction pad and contacting the pickup roller, the paper edge sensor to sense a top edge of the paper picked up by the pickup roller.

16. The image forming apparatus of claim 15, wherein a rotational speed of the pickup roller is substantially equal to or greater than that of the photoconductive medium.

17. The image forming apparatus of claim 15, wherein a distance $D_1$ is substantially equal to or greater than a distance $D_2$, the distance $D_1$ being a vertical distance from a sensing point $C_1$ of the paper edge sensor to an image-forming point $C_2$ of the photoconductive medium and the distance $D_2$ being a circumferential distance of the photoconductive medium from the image-forming point $C_2$ to a transfer nip $C_3$ between the transferring roller and the photoconductive medium.

* * * * *